US009490092B2

(12) United States Patent
Lu et al.

(10) Patent No.: US 9,490,092 B2
(45) Date of Patent: Nov. 8, 2016

(54) CIRCUIT BREAKER

(71) Applicant: NOARK ELECTRICS (SHANGHAI) CO., LTD., Shanghai (CN)

(72) Inventors: Qian Lu, Shanghai (CN); Pengbin Yan, Shanghai (CN)

(73) Assignee: NOARK ELECTRICS (SHANGHAI) CO., LTD. (CN)

( * ) Notice: Subject to any disclaimer, the term of this patent is extended or adjusted under 35 U.S.C. 154(b) by 0 days.

(21) Appl. No.: 14/430,686

(22) PCT Filed: Mar. 26, 2013

(86) PCT No.: PCT/CN2013/073184

§ 371 (c)(1),
(2) Date: Mar. 24, 2015

(87) PCT Pub. No.: WO2014/048095

PCT Pub. Date: Apr. 3, 2014

(65) Prior Publication Data

US 2015/0248987 A1 Sep. 3, 2015

(30) Foreign Application Priority Data

Sep. 25, 2012 (CN) ..... 2012 2 0495282 U

(51) Int. Cl.
*H01H 71/08* (2006.01)
*H01H 71/02* (2006.01)
*H01R 4/38* (2006.01)

(52) U.S. Cl.
CPC ..... *H01H 71/08* (2013.01); *H01H 71/02* (2013.01); *H01R 4/38* (2013.01)

(58) Field of Classification Search
CPC ..... H01H 71/02; H01H 71/08
USPC ..... 200/293, 296, 297, 19.18, 19.2, 19.22, 200/19.27, 19.3, 49, 553, 558, 339, 307, 200/50.32, 50.35, 304–305
See application file for complete search history.

(56) References Cited

U.S. PATENT DOCUMENTS 2,321,603 A * 6/1943 Jensen ..... H01H 71/2463 200/296

(Continued)

FOREIGN PATENT DOCUMENTS

CN 1207828 2/1999
CN 197 99 55 6/2007

(Continued)

OTHER PUBLICATIONS

International Search Report dated Jul. 11, 2013 issued in corresponding International patent application No. PCT/CN2013/073184.

(Continued)

*Primary Examiner* — Edwin A. Leon
(74) *Attorney, Agent, or Firm* — Ostrolenk Faber LLP

(57) ABSTRACT

A circuit breaker includes a housing, wiring boards and terminals disposed within the housing, wherein the terminal comprises a screw, a press board and a wire trap provided with a incoming line hole and a wiring space; the screw passes through a threaded hole on the top end face of the wire trap to contact the press board which is able to lift up and down and is embedded in the wire trap; the wiring board traverses the wire trap, and divides the wiring space of the wire trap into two independent wiring spaces; a first line hole is provided on the housing at a position above the screw of the terminal; and the press board and the wire trap perform a relative displacement with the wiring board under the action of the screw, to compress the two independent wiring spaces so as to realize the connection between wires. In the circuit breaker, with the wiring board as a boundary, the wiring space of the wire trap is divided into two independent wiring spaces, realizing a hybrid junction of commonly used wires while realizing the hybrid junction wiring function of single-strand wires with different diameter.

9 Claims, 7 Drawing Sheets

(56) References Cited

U.S. PATENT DOCUMENTS

| | | | | |
|---|---|---|---|---|
| 3,054,025 | A * | 9/1962 | Edmunds | H01R 13/642 200/281 |
| 3,369,099 | A * | 2/1968 | Norden | H01H 71/0221 200/293 |
| 7,462,791 | B1 * | 12/2008 | Flegel | H01H 9/26 200/50.32 |
| 8,044,312 | B2 * | 10/2011 | Orban | H01H 71/0271 200/304 |
| 8,536,475 | B2 * | 9/2013 | Washburn | H01H 71/08 200/293 |
| 2006/0061441 | A1 | 3/2006 | Whipple et al. | |
| 2010/0173541 | A1 | 7/2010 | Borona et al. | |

FOREIGN PATENT DOCUMENTS

| | | |
|---|---|---|
| CN | 101 170 015 | 4/2008 |
| CN | 201508813 | 6/2010 |
| CN | 102 055 080 | 5/2011 |
| CN | 102 881 528 | 1/2013 |
| CN | 202 816 824 | 3/2013 |
| EP | 2 315 313 | 4/2011 |
| FR | 2 358 575 | 2/1978 |
| WO | WO-9722986 | 6/1997 |

OTHER PUBLICATIONS

European Search Report dated Apr. 28, 2016 issued in related, European Application No. 13 84 0500.

* cited by examiner

CIRCUIT BREAKER

CROSS REFERENCE TO RELATED APPLICATIONS

The present application is a 35 U.S.C. §371 National Phase conversion of PCT/CN2013/073184, filed Mar. 26, 2013, which claims benefit of Chinese Application No. 201220495282.3, filed Sep. 25, 2012, the disclosure of which is incorporated herein by reference. The PCT International Application was published in the Chinese language.

TECHNICAL FIELD OF THE INVENTION

The present invention relates to a circuit breaker in the field of power distribution, and more particularly, to a circuit breaker that may realize a hybrid junction of various wires.

BACKGROUND OF THE INVENTION

The existing circuit breaker, particularly a miniature circuit breaker realizes its wiring function through the reliable connection between terminals and loop wires. The circuit breaker is mainly used for protecting end of the lines in the early stage. With regard to this loop, it may be obtained and applied as long as one wiring function of the wire is realized. With the enlarged application range of the circuit breaker, branched wiring is usually performed on each phase of a circuit breaker in a next-stage parallel system or parallel lines due to the need of distribution of power system or circuit design. For example, when the line is required from the outlet end of the master switch into multiple parallel branches, it usually employs a manner of performing parallel wiring on the same phase terminals of the circuit breakers on these parallel branches. After this wiring manner is employed, the type of wires that can be connected to the circuit breaker is increased from one type initially to two types. The increased wiring type causes various permutation and combination of wires that may be connected to the existing circuit breaker. At present, the wires commonly used by the circuit breaker in the market include: multi-strand wires, single-strand wires, bus (bus bar) and wires having annular joints used for realizing quick wiring. Therefore, a circuit breaker that can realize the wiring function of combination of any two commonly used wires will adapt for the market demands more quickly.

In the existing technical field, the following technical solutions are employed to realize the wiring function of the circuit breaker.

The first technical scheme, as shown in FIG. 1, wherein wiring boards and terminals are mounted within a housing of a circuit breaker. The terminal includes a wire trap that can generate relative movement with the wiring board, and a screw that is in screw-thread fit with the wire trap. A wire is connected between the wire trap and the wiring board, and is fastened through the screw to realize the wiring function of the circuit breaker.

The second technical scheme, as shown in FIG. 2, which is the most common wiring manner of the circuit breaker at present. On the basis of the first technical solution, a second wiring board is added on the movement direction of the wire trap. This wiring board is equipotential with the original first wiring board. The screw in screw-thread fit with the wire trap traverses said second wiring board, and the bus (bus bar) wiring function is realized through the screw and the second wiring board.

By carefully comparing the existing two technical solutions, it is not difficult to find that if the second technical solution is taken as the basis, the bus (bus bar) function used in the first technical solution can also be designed. Compared with the first technical solution, the second technical solution separates the bus (bus bar) wiring function from the conventional wiring function and makes the two functions independent mutually through the two wiring boards. This enables the second technical solution to realize all the wiring functions of the first technical solution while realizing the bus (bus bar) wiring function; but, it is inevitably to make the terminals and wiring board structure relatively complicated.

Moreover, in the foregoing two technical solutions, only one wiring space is formed between the wiring board and the wire trap, and a hybrid junction of single-strand wires with different diameter cannot be realized on the combination of the wires that can be connected.

Meanwhile, none of the two technical solutions can realize to use the wires having annular joints in quick wiring, and only the bus (bus bar) wiring function can be used.

Further, as described in the foregoing two technical solutions, after the circuit breaker finishes the wiring of the wires, it is not difficult to image that when multi-pole circuit breaker connecting wires, the exposed wire end is outside the circuit breaker housing, and the electrical clearance and the creepage distance of two adjacent wires are very small. If the wires are short connected, it will necessarily bring security risks. When using the bus (bus bar) wiring, although short circuit between adjacent poles does not exist, the electrical clearance and the creepage distance are too small; during a long term usage process, security risks of use in later period will also be brought due to the reduced performances of insulating materials.

SUMMARY OF THE INVENTION

The technical problem to be solved by the present invention is to provide a circuit breaker which has simple structure, can realize a hybrid junction of various wires, and can provide safety for connection of wires.

The object of the present invention is fulfilled by employing the following technical solution.

The present invention discloses a circuit breaker, which includes a housing, wiring boards 1 and terminals 2 disposed within the housing. The terminal 2 includes a screw 6, a press board 7 and a wire trap 8 provided with a incoming line hole and a wiring space, said screw 6 passes through a threaded hole on the top end face 29 of the wire trap 8 and contacts with the press board 7 which is able to lift up and down and embedded in the wire trap 8. Said wiring board 1 traverses the wire trap 8, and divides the wiring space of the wire trap 8 into two independent wiring spaces 23, 24. A first wiring space 23 is formed among the wiring board 1, the press board 7 and the side walls of the wire trap 8. A second wiring space 24 is formed among the wiring board 1, the bottom end face 14 of the wire trap 8 and the side walls of the wire trap 8. A first line hole 4 is provided in the housing at a position above the screw 6 of the terminal 2. The press board 7 and the wire trap 8 perform a relative displacement with the wiring board 1 under the action of the screw 6 to compress the two independent wiring spaces so as to realize the connection between wires.

Further, said inner wall of the housing is provided with a guide board 12 for guiding the wires connected to the two independent wiring spaces 23, 24 on an incoming line direction that connects the wires with the terminal 2. The wires can be conveniently guided by the guide board to respectively enter the two independent wiring spaces.

Further, said inside of the housing is provided with a wiring channel 20 for holding a wire exposed end on the incoming line direction that connects the wires with the terminal 2. The wire exposed end when the wire is connected to the terminal is disposed in the housing through the wiring channel. Moreover, the creepage distance and the electrical clearance are increased, which effectively isolates the security risks between adjacent wires after the wire is connected to the multipole circuit breaker, thus realizing electrical safety.

Further, the circuit breaker further includes a wiring bar annex 22 which may be connected to a bus (bus bar) wire. The wiring bar annex 22 includes a connecting bar 18 connected to any one of the two independent wiring spaces 23, 24, and an insulation baffle 16 used for fixing the connecting bar 18 and provided with a incoming line hole. The insulation baffle 16 is fixed on the housing along the incoming line direction of the wire. The hybrid junction of the wires having bus bar type's connection is realized through the wiring bar annex, thus expanding the types of the wires that can be connected to the circuit breaker in a hybrid manner.

Further, the connecting bar 18 is provided with a wiring screw 17 which may be connected to a wire having annular joints, and the housing is provided with a second line hole 3 at a position above the wiring screw 17 of the wiring bar annex 22. The hybrid junction with the wires having annular joints can be realized through the setting of adding the wiring screw, thus expanding the types of the wires that can be connected to the circuit breaker in a hybrid manner.

Further, the insulation baffle 16 is provided with a stop pin 15, and the stop pin 15 is mutually engaged with a stop gear 19 disposed on the corresponding position of the housing to realize self-locking and fixing of the insulation baffle 16. This is a specific insulation baffle fixing structure. The mutual engaging of the stop pin and the stop gear not only can guarantee the installation intensity, but also is convenient to assemble and disassemble.

Further, the circuit breaker forms the wiring channel 20 having a distance not smaller than the distance between the first line hole 4 and the second line hole 3 and holding the wire exposed end on the incoming line direction that connects the wires with the terminal 2 in the housing. Due to the design of the first line hole, the second line hole and the additionally disposed wiring bar annex, a pair of wiring channels having a distance not smaller than the distance between the first line hole and the second line hole on the incoming line direction that connects the wires with the terminal in the housing are formed, thus being capable of realizing electrical safety.

Further, the connecting bar 18 includes an electrical connecting element 27 embedded into any one of the two independent wiring spaces 23, 24, and a mounting element 28 fixedly connected to the electrical connecting element 27. The width of the mounting element 28 is larger than the width of the electrical connecting element 27, and the wiring screw 17 is disposed on the mounting element 28. This is a specific connecting bar structure.

Further, the housing is provided with a locating surface 10 corresponding to connecting bar end face 21 at the two sides of the mounting element 28 of the connecting bar 18. After the electrical connecting element 27 is embedded into any one of the two independent wiring spaces 23, 24, the connecting bar end faces 21 are embedded into the locating surface 10. While ensuring the connecting bar connected into the wiring space to realize reliable guide, the locating surface offset counteract torque generated by the wiring screw of the connecting bar when the connecting bar is connected to the wire having annular joints, prevents the connecting bar from swinging along the torque plane, and ensures the reliable wiring function of the wiring bar annex.

In the circuit breaker, with the wiring board as a boundary, the wiring space of the wire trap is divided into two independent wiring spaces, and equivalently separating out two terminals, wherein the two terminals may finish respective wiring functions thereof and do not interfere with each other. The invention has simple structure, and also realizes a wiring function of hybrid junction of single-strand wires with different diameter while reserving all the wiring functions of the existing first technical solution. Further, the invention may also be additionally provided with the wiring bar annex connected to the terminal to realize the hybrid junction with the wires having bus (bus bar) type joints in the second technical solution in the case of not increasing the wiring board, thus expanding the types of the wires that can be connected to the circuit breaker in a hybrid manner. Further, the invention is provided with the wiring screw on the connecting bar annex to realize hybrid junction with the wires having annular joints, thus further expanding the types of the wires that can be connected to the circuit breaker in a hybrid manner. Further, the wiring channel is equipped within the housing, and the wire exposed end when the wire is connected to the terminal is disposed within the housing through the wiring channel. Moreover, the creepage distance and the electrical clearance are increased, which effectively isolates the security risks between adjacent wires after the wire is connected to the multipole circuit breaker, thus realizing electrical safety.

Figure 1:
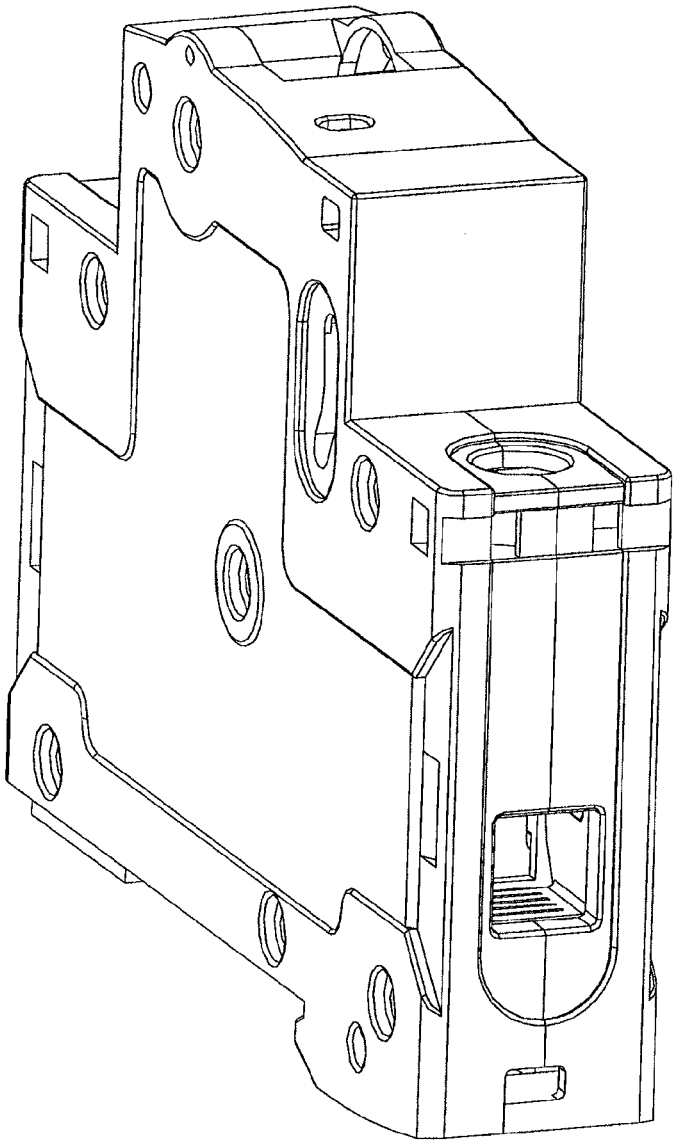
FIG. 1 is a schematic view of a circuit breaker of the existing first technical solution.
Figure 2:
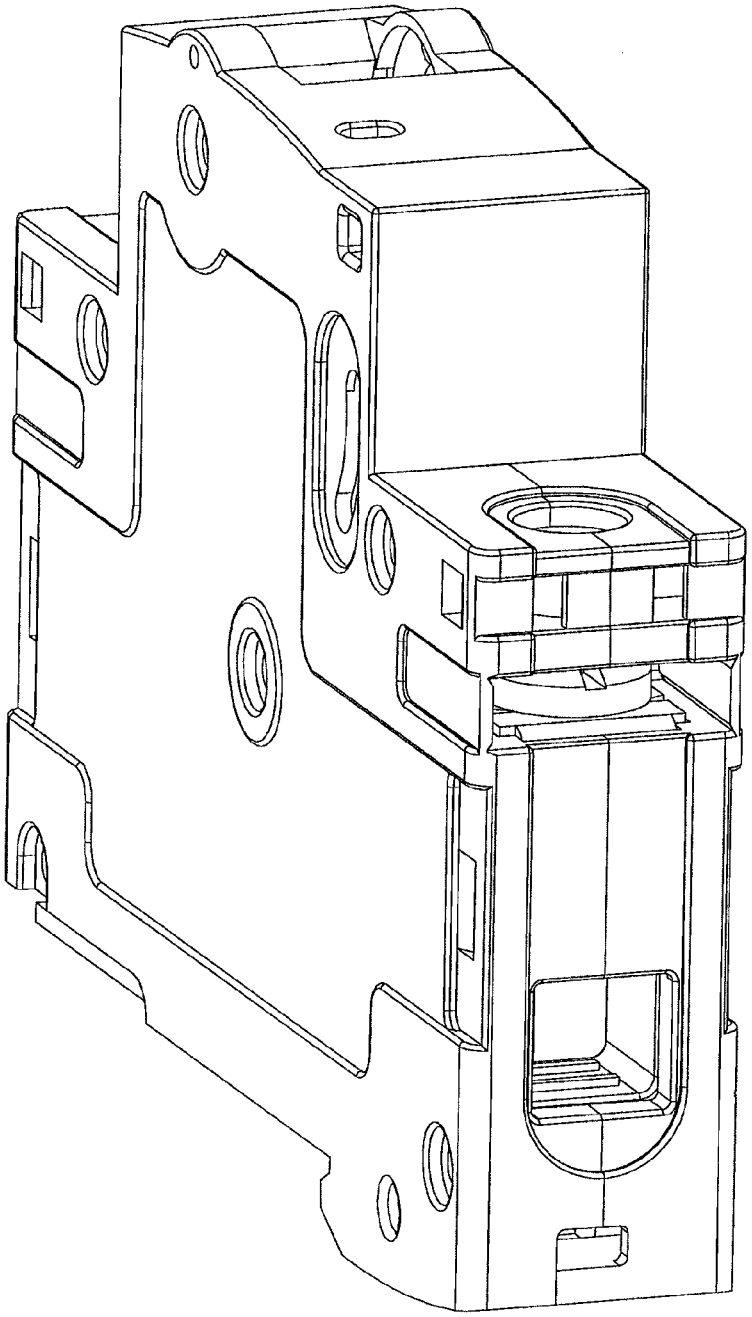
FIG. 2 is a schematic view of a circuit breaker of the existing second technical solution.
Figure 3:
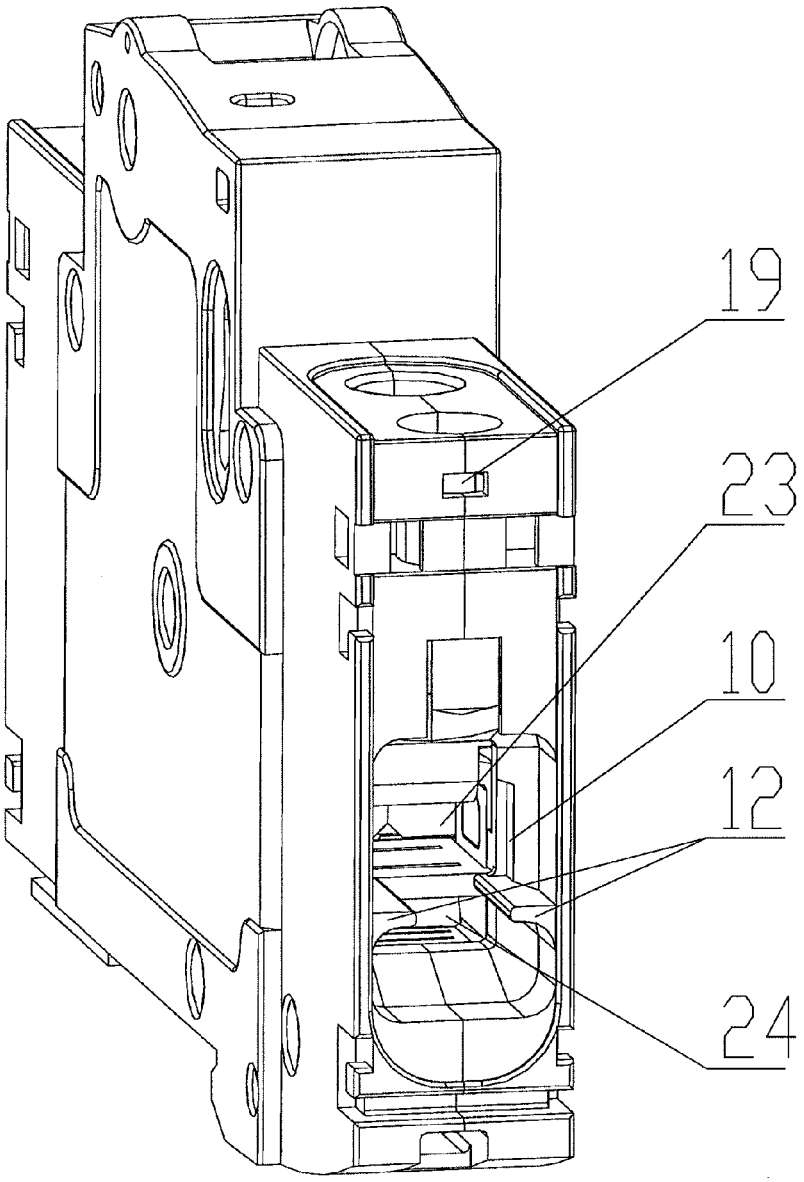
FIG. 3 is a schematic view of a circuit breaker according to an embodiment of the present invention.
Figure 4:
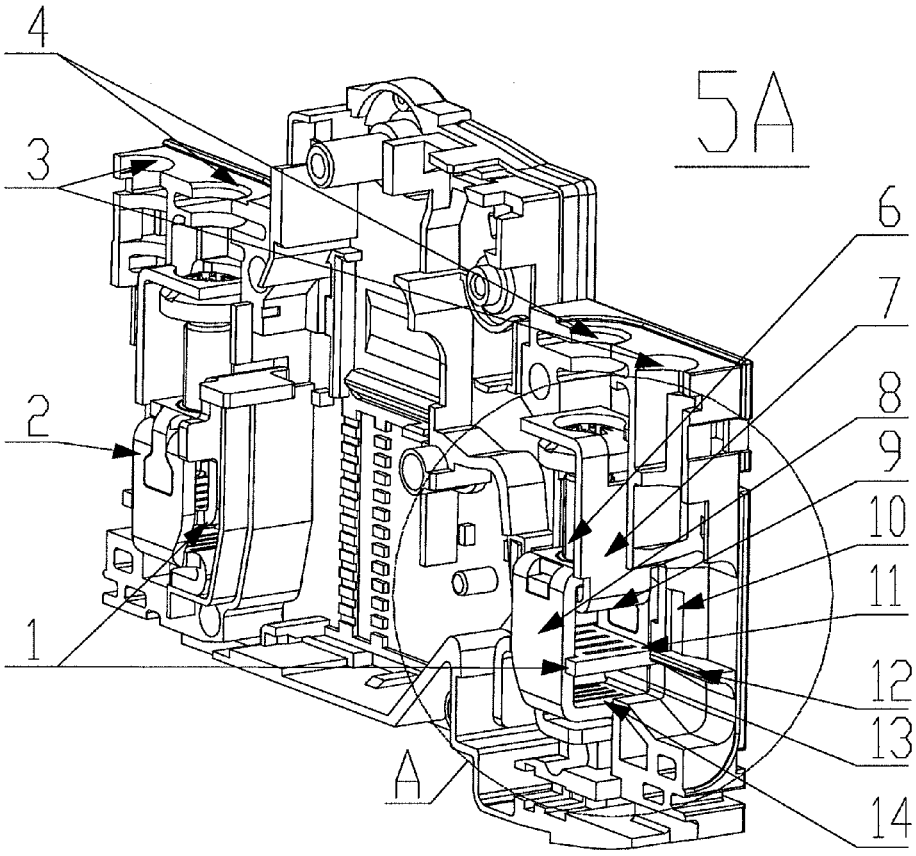
FIG. 4 is a schematic view of a first housing of the circuit breaker according to an embodiment of the present invention.
Figure 5:
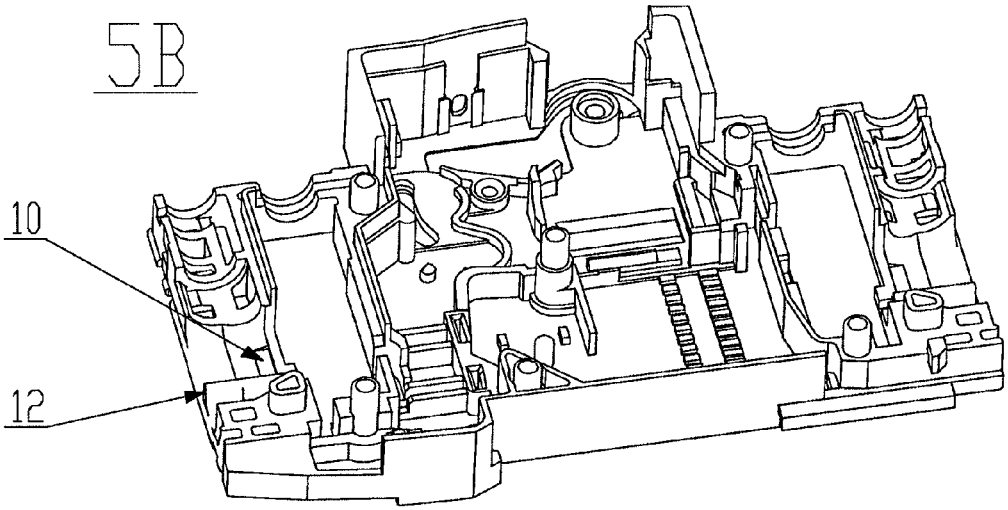
FIG. 5 is a schematic view of a second housing of the circuit breaker according to an embodiment of the invention.
Figure 6:
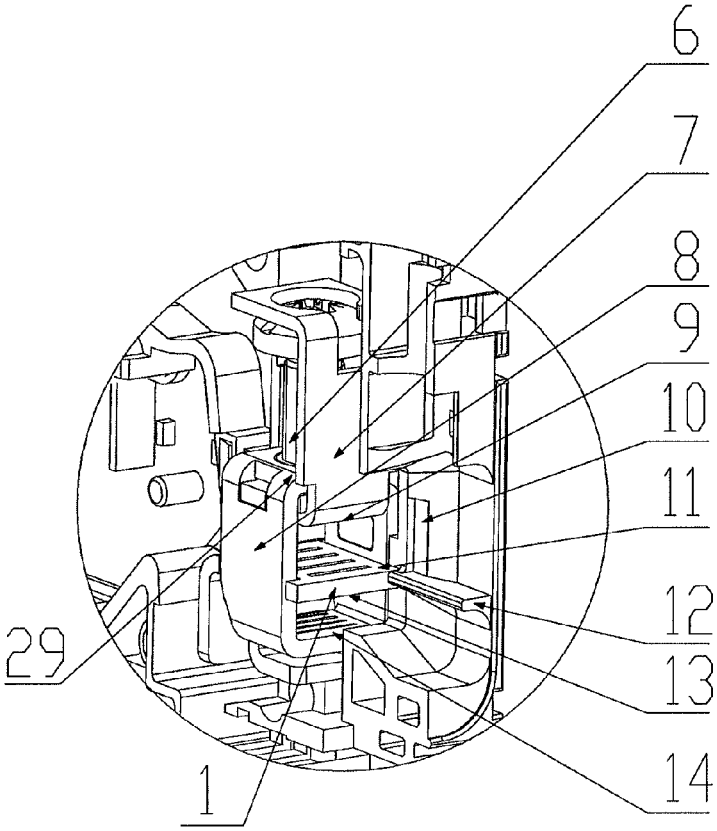
FIG. 6 is a partial enlarged schematic view of portion A of FIG. 4.

Where: 1 refers to wiring board; 2 refers to terminal; 3 refers to second line hole; 4 refers to first line hole; 5A refers to first housing; 5B refers to second housing; 6 refers to screw; 7 refers to press board; 8 refers to wire trap; 9 refers to end face of press board; 10 refers to locating surface; 11 refers to upper end face of wiring board; 12 refers to guide board; 13 refers to lower end face of wiring board; 14 refers to bottom end face of wire trap; 15 refers to stop pin; 16 refers to insulation baffle; 17 refers to wiring screw; 18 refers to connecting bar; 19 refers to stop gear; 20 refers to wiring channel; 21 refers to end face of connecting bar; 22 refers to wiring bar annex; 23 refers to first wiring space; 24 refers to second wiring space; 27 refers to electrical connecting element; 28 refers to mounting element; and 29 refers to top surface of wire trap.

DETAILED DESCRIPTION OF THE PREFERRED EMBODIMENTS OF THE INVENTION

The present invention discloses a circuit breaker, which includes a housing, wiring boards 1 and terminals 2 equipped within the housing. Each terminal 2 includes a screw 6, a press board 7 and a wire trap 8 provided with a incoming line hole and a wiring space. The screw 6 passes through a threaded hole on the top end face 29 of the wire trap 8 and contacts with the press board 7 which is able to lift up and down and embedded in the wire trap 8. The wiring board 1 traverses the wire trap 8 and divides the wiring space of the wire trap 8 into two independent wiring spaces 23, 24. A first wiring space 23 is formed among the wiring board 1, the press board 7 and the side walls of the wire trap 8. A second wiring space 24 is formed among the wiring board 1, the bottom end face 14 of the wire trap 8 and the side walls of the wire trap 8. The housing is provided with a first line hole 4 at a position above the screw 6 of the terminal 2. The press board 7 and the wire trap 8 perform a relative displacement with the wiring board 1 under the action of the screw 6 to compress the two independent wiring spaces so as to realize the connection between wires. Further, the circuit breaker further of the present invention further includes a wiring bar annex 22 which may be connected to a bus (bus bar) wire. The wiring bar annex 22 includes a connecting bar 18 connected to any one of the two independent wiring spaces 23, 24, and an insulation baffle 16 used for fixing the connecting bar 18 and provided with a incoming line hole. The insulation baffle 16 is fixed on the housing along the incoming line direction of the wire. Further, the connecting bar 18 is provided with a wiring screw 17 which may be connected to a wire having annular joint, and the housing is provided with a second line hole 3 at a position above the wiring screw 17 of the wiring bar annex 22.

In the circuit breaker of the invention, with the wiring board as a boundary, a wiring space of the wire trap is divided into two independent wiring spaces, and equivalently separating out two terminals, wherein the two terminals may finish respective wiring functions thereof and do not interfere with each other. The invention has simple structure, and also realizes a hybrid junction of single-strand wires with different diameter while reserving all the wiring functions of the existing first technical solution. Further, the invention may also be additionally provided with a wiring bar annex connected to the terminal to realize hybrid junction with the wires having bus bar type joints in the existing second technical solution in the case of not increasing a wiring board, thus expanding the types of the wires that can be connected in a hybrid manner in the circuit breaker. Further, the invention is provided with the wiring screw on the connecting bar annex to realize hybrid junction with the wires having annular joint, thus further expanding the types of the wires that can be connected in a hybrid manner in the circuit breaker. Further, the wiring channel is disposed in the housing, and the wire exposed end when the wire is connected to the terminal is disposed in the housing through the wiring channel. Moreover, the creepage distance and the electrical clearances are increased, which effectively isolates the security risks between adjacent wires after the wire is connected to the multipole circuit breaker, thus realizing electrical safety.

The invention will be further described hereinafter with reference to the drawings and preferred embodiments.

As shown in FIGS. 3 to 6, the circuit breaker of the embodiment includes an enclosed housing. The housing includes insulated first housing 5A and second housing 5B. The insides of the first housing 5A and the second housing 5B are provided with spaces for holding each part of the circuit breaker, and various splicing and fastening components, and an operating mechanism, a contact device, a trip unit, an explosion chamber and so on of the circuit breaker are respectively fixed inside the two housings, then the two housings are spliced and fixed to form the complete circuit breaker, meanwhile, the internal components to achieve a reliable secured and sealed.

Inside the housing of the circuit breaker, both the positions of terminal and leading-out terminal are provided with a wiring board 1 and a terminal 2. The terminal 2 includes a wire trap 8 mutually fit with the wiring board 1 and capable of generating relative movement with the wiring board 1, a screw 6 in screw thread fit with the wire trap 8, and a press board 7 mutually fit with the screw 6 and generating relative movement with the wiring board 1 with the pushing of the screw 6. The wire trap 8 is provided with a incoming line hole and a wiring space, and is in a hollow rectangle structure, wherein the hollow portion thereof is the wiring space. The top end face 29 of the wire trap 8 is provided with a threaded hole. The screw 6 is disposed in the threaded hole. The screw thread end of the screw 6 is contacted with the press board 7 which is able to lift up and down and embedded in the wire trap 8 through the threaded hole. The wiring board 1 also traverses the interior of the wire trap 8. The wiring board 1 is fixed on the housing to divide the wiring space of the wire trap 8 into two mutually independent wiring spaces. A first wiring space 23 is formed among the wiring board 1, the press board 7 and the side walls of the wire trap 8. A second wiring space 24 is formed among the wiring board 1, the bottom end face 14 of the wire trap 8 and the side walls of the wire trap 8. The housing is provided with a first line hole 4 at a position above the screw 6 of the terminal 2. A screw driver may enter the housing through the first line hole 4 to tighten the screw, when installing the wires. The inner wall of the first housing 5A and the inner wall of the second housing 5B are provided with a convex guide board 12 for guiding the wires connected to the two independent wiring spaces on a incoming line direction that connects the wires with the terminal 2. The end face of the guide board 12 is flush with the end face of the wiring board 1. The wires may be guided conveniently to enter separately the corresponding two independent wiring spaces through the guide board 12.

When connecting the wires, the screw 6 is screwed to fasten. Firstly, the press board 7 will move towards the wiring board 1 constantly with the pushing of the screw 6 to fix the wires between the press board 7 and the wiring board 1 and realize the wiring function of the first wiring space 23. The screw 6 is tightened continuously. After the press board end face 9 is contacted with the upper end face 11 of the wiring board, the screw 6 will not move downwards. The wire trap 8 under the action of screw thread fit moves upwards along the screw 6. The bottom end face 14 of the wire trap moves towards the lower end face 13 of the wiring board to compact the wire between the wire trap 8 and the wiring board 1, thus realizing the wiring function of the second wiring space 24 and finally finishing the wiring function of any two commonly used wires, while both the two wiring spaces can be considered as independent terminals.

The embodiment has simple structure. With the wiring board as a boundary, the wiring space of the wire trap is divided into two independent wiring spaces, wherein the two wiring spaces can finish respective wiring functions. The connection of common wires like multi-strand wires, single-strand wires and the like can be realized; meanwhile, the wiring function of hybrid junction of single-strand wires with different diameter is also realized. According to the technical solution, with one wiring board as a boundary, the wiring space of the wire trap is divided into two mutually independent wiring spaces. It is apparent for those skilled in the art to expand the technical solution into a plurality of wiring boards, wherein these wiring boards are all at the same electrical potential. With the wiring board as a boundary, the space of the wire trap is divided into a plurality of independent spaces, thus realizing hybrid junction of a plurality of commonly used wires.

Figure 7:
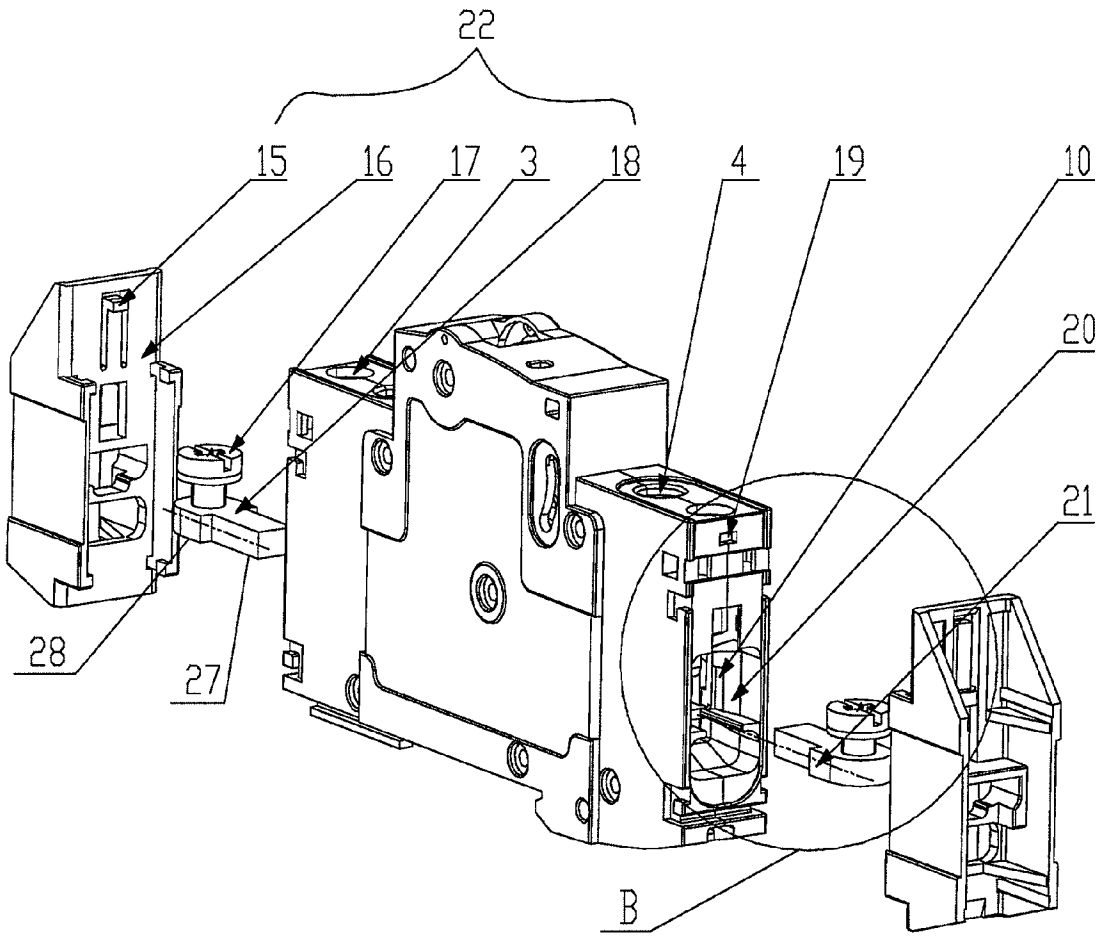
FIG. 7 is a schematic view of a circuit breaker having a wiring bar annex according to an embodiment of the invention.
Figure 8:
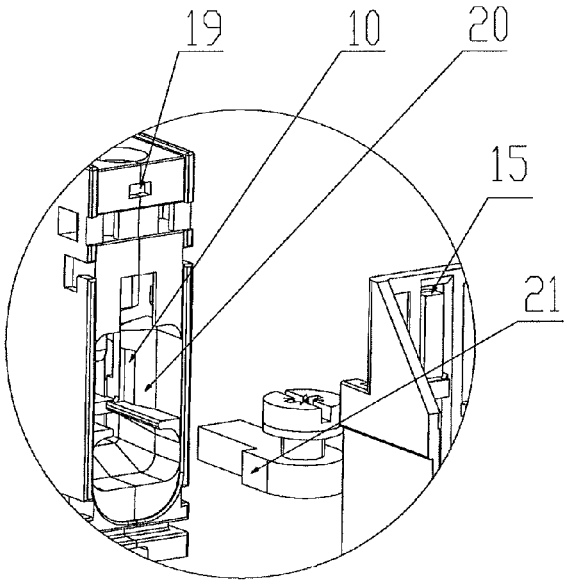
FIG. 8 is a partial enlarged schematic view of portion B of FIG. 7.
Figure 9:
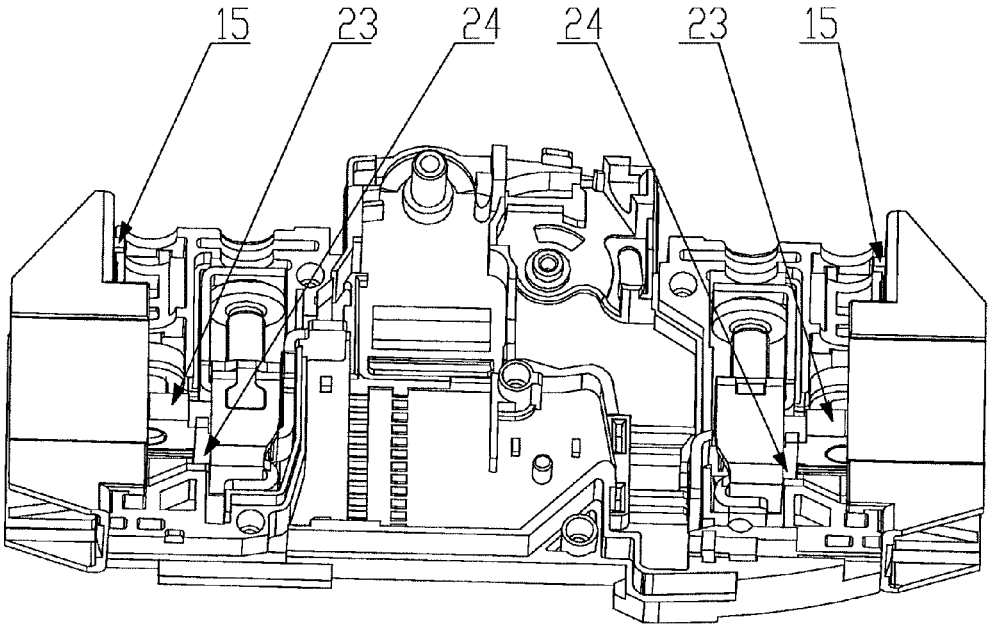
FIG. 9 is a schematic view of mounting completion of the wiring bar annex according to an embodiment of the invention.

The wire connecting solution of the two independent wiring spaces formed through the first line hole 4, the terminal 2 and the wiring board 1 is suitable for commonly used wiring boards and terminals, and has a certain restriction on the types of the wire joints that can be installed. Therefore, in order to expand the application scope of the circuit breaker so as to adapt to more types of wire joints, the circuit breaker may also be additionally provided with a wiring bar annex 22 that may be connected to a bus (bus bar) wire according to the wiring conditions. As shown in FIGS. 7 to 9, the wiring bar annex 22 includes a connecting bar 18 connected to any one of the two independent wiring spaces 23, 24, and an insulation baffle 16 used for fixing the connecting bar 18 and provided with a incoming line hole. The insulation baffle 16 is fixed on the housing along the incoming line direction of the wire. When installing the wiring bar annex 22, the connecting bar 18 is connected into any one of the independent wiring spaces of the terminal 2 and a certain installation torque is kept. After the insulation baffle 16 is installed and fit on the housing along the incoming line direction of the wire, the installation of the wiring bar annex 22 is finished, thus realizing the expansion of the wiring function and ensures electrical safety. The embodiment realizes hybrid junction with the bus (bus bar) wire through the wiring bar annex 22.

Further, the connecting bar 18 is provided with a wiring screw 17 which may be connected to a wire having annular joint, and the housing is provided with a second line hole 3 at a position above the wiring screw 17 of the wiring bar annex 22. A screw driver may enter the housing through the second line hole 3 to tighten the screw 17. The second line hole 3 and the first line hole 4 are disposed in parallel and extend along the fit plane of the first housing 5A and the second housing 5B. The embodiment realizes hybrid junction with the bus (bus bar) wire through the wiring bar annex 22. The embodiment realizes hybrid junction with the wire having annular joint through the setting of increasing the wiring screw.

As shown in FIG. 7, the connecting bar 18 in the embodiment includes a electrical connecting portion 27 embedded into any one of the two independent wiring spaces 23, 24, and an mounting element 28 fixedly connected to the electrical connecting element 27. The electrical connecting element 27 is a square cylinder, and the width of the mounting element 28 is larger than the electrical connecting element 27; in this way, the portion of the mounting element 28 exceeding the electrical connecting element 27 is just formed a flange portion, i.e., forming two wiring channel end faces 21. The wiring screw 17 is disposed on the mounting element 28.

The first housing 5A and the second housing 5B are provided with a locating surface 10 corresponding to connecting bar end faces 21 at the two sides of the mounting element 28 of the connecting bar 18. After the electrical connecting element 27 is embedded into any one of the two independent wiring spaces 23, 24, the connecting bar end faces 21 are embedded into said locating surface 10. While ensuring the connecting bar 18 connected into said wiring space to realize reliable guide, the locating surface 10 offset the counteract torque generated by the wiring screw 17 of the connecting bar 18 when the connecting bar 18 is connected to the wire having annular joint, prevents the connecting bar 18 from swinging along the torque plane, and ensures the reliable wiring function of the wiring bar annex 22.

The insulation baffle 16 is provided with a stop pin 15, and the stop pin 15 is mutually engaged with a stop gear 19 disposed on a corresponding position of the housing to realize self-locking and fixing of the insulation baffle 16. After the insulation baffle 16 is fit on the housing along the installing direction, the stop pin 15 and the stop gear 19 are mutually engaged, which prevents the insulation baffle 16 from sliding on or falling off the housing along the installing direction to realize said self-locking of the insulation baffle 16 and ensures the safety of said wiring bar annex 22, and is also convenient to assemble and disassemble.

It is apparent that the embodiment employs two pairs of line holes (first line hole 4 and second line hole 3) disposed in parallel and the design of the wiring bar annex 22 that can be additionally disposed to form the wiring channel 20 having a distance not smaller than the distance between the first line hole 4 and the second line hole 3 and holding the wire exposed end on the incoming line direction that connects the wires with the terminal 2 in the housing. Due to the wiring channel 20, the wiring opening of the terminal 2 is equivalent to be embedded into the interior of the housing and the wires are connected to the interior of the terminal 2. Even if partial metal is exposed outside the terminal 2, the wiring channel 20 may also isolate the exposed portion. When the wires of a multipole circuit breaker are completely connected, the adjacent wires are mutually separated by the wiring channels so as to improve the creepage distance and the electrical clearance, eliminate the security risks of short-circuit connection between the wires, and realizes electrical safety. In other words, the embodiment prevents the security risks brought by that the wire exposed end is disposed outside the housing of the circuit breaker, and prevents the security risks brought by that too small of the electrical clearance and the creepage distance between two adjacent wires after the wires of the multi pole circuit breaker are connected.

Certainly, it is not difficult to image that the electrical safety function realized by the embodiment through the wiring channel 20 may also be realized in a common circuit breaker that does not have two pairs of line holes and the design of additionally arranging the wiring bar annex, as long as a certain protection channel is reserved at the incoming line opening of the wire of the terminal in the housing, which will certainly increase the volume of the circuit breaker.

The above-mentioned contents are further descriptions to the present invention with reference to the specific preferred embodiments, and it cannot be deemed that the specific implementation of the present invention are only limited to these descriptions. Those having ordinary skills in the art of the present invention may also make many simple deductions or replacements without departing from the conceive of the present invention which shall all fall within the protection scope of the present invention.

The invention claimed is:

1. A circuit breaker, comprising a housing, wiring boards and terminals disposed within the housing, wherein:

the terminal comprises a screw, a press board and a wire trap provided with a incoming line hole and a wiring space; the screw passes through a threaded hole on the top end face of the wire trap and contacts with the press board which is able to lift up and down and is embedded in the wire trap;

the wiring board traverses the wire trap, and divides the wiring space of the wire trap into two independent wiring spaces; a first wiring space is formed among the wiring board, the press board and the side walls of the wire trap, and a second wiring space is formed between the wiring board, the bottom end face of the wire trap and the side walls of the wire trap;

a first line hole is provided on the housing at a position above the screw of the terminal; and the press board and the wire trap perform a relative displacement with the wiring board under the action of the screw to compress said two independent wiring spaces so as to realize the connection between wires; and the circuit breaker further comprises a wiring bar annex which may be connected to a bus bar wire; said wiring bar annex comprises a connecting bar connected to any one of the two independent wiring spaces and an insulation baffle used for fixing the connecting bar and provided with an incoming line hole; the insulation baffle is fixed on the housing.

2. The circuit breaker according to claim 1, wherein the inner wall of the housing is provided with a guide board for guiding the wires connected to the two independent wiring spaces on a incoming line direction that connects the wires with the terminal.

3. The circuit breaker according to claim 1, wherein the inside of the housing is provided with a wiring channel for holding a wire exposed end on the incoming line direction that connects the wires with the terminal.

4. The circuit breaker according to claim 1, wherein the insulation baffle is fixed on the housing along the incoming line direction of the wire.

5. The circuit breaker according to claim 4, wherein the connecting bar is provided with a wiring screw which may be connected to a wire having an annular joints, and the housing is provided with a second line hole at a position above the wiring screw of the wiring bar annex.

6. The circuit breaker according to claim 4, wherein the insulation baffle is provided with a stop pin, said stop pin is mutually engaged with a stop gear disposed on the corresponding position of the housing to realize self-locking and fixing of the insulation baffle.

7. The circuit breaker according to claim 5, wherein the wiring channel is formed within the housing of the circuit breaker, which have a distance not smaller than the distance between the first line hole and the second line hole and hold the wire exposed end on the incoming line direction that connects the wires with the terminal.

8. The circuit breaker according to claim 5, wherein the connecting bar comprises an electrical connecting element embedded into any one of the two independent wiring spaces, and an mounting element fixedly connected to the electrical connecting element; the width of the mounting element is larger than the width of the electrical connecting element, and said wiring screw is disposed on the mounting element.

9. The circuit breaker according to claim 8, wherein the housing is provided with a locating surface corresponding to connecting bar end faces at the two sides of the mounting element of the connecting bar; after the electrical connecting element is embedded into any one of the two independent wiring spaces, the connecting bar end faces are embedded into the locating surface.

* * * * *